United States Patent [19]

Magida

[11] 4,262,904

[45] Apr. 21, 1981

[54] CYLINDRICAL GAME DEVICE WITH CIRCUMFERENTIAL WALLS

[76] Inventor: David N. Magida, 232 W. Elm St., New Haven, Conn. 06515

[21] Appl. No.: 123,847

[22] Filed: Feb. 22, 1980

[51] Int. Cl.[3] ..... A63F 7/04

[52] U.S. Cl. ..... 273/113; 273/116

[58] Field of Search ..... 273/108, 109, 110, 113, 273/115, 116, 112, 123 R

[56] References Cited

U.S. PATENT DOCUMENTS

| | | | |
|---|---|---|---|
| 489,394 | 1/1893 | Spencer | 273/109 |
| 531,671 | 1/1895 | Williams | 273/109 |
| 600,696 | 3/1898 | Patterson | 273/113 |
| 658,097 | 9/1900 | Smith | 273/115 |
| 876,779 | 1/1908 | Dever et al. . | |
| 1,352,517 | 9/1920 | King . | |
| 3,005,635 | 10/1961 | Greene . | |
| 3,552,750 | 1/1971 | Lomberk et al. | 273/112 |
| 3,612,533 | 10/1971 | Breslow | 273/113 |
| 3,901,510 | 8/1975 | Demaio . | |
| 3,924,857 | 12/1975 | Christensen | 273/113 |

*Primary Examiner*—Richard C. Pinkham

*Assistant Examiner*—Scott L. Brown

*Attorney, Agent, or Firm*—Albert Gordon

[57] ABSTRACT

A game device comprising a cylinder (10) formed of a pair of side walls (18) and an outer circumferential wall (22) spanning the side walls. An inner circumferential wall (24) and a middle circumferential wall (26) span the side walls (18) with the middle circumferential wall being located between the inner and outer circumferential walls and the three circumferential walls being spaced from each other. A barrier (28) spanning the side walls (18) extends radially between the three circumferential walls. An entry hole (20) extends through the outer circumferential wall adjacent to and on a first side of the barrier (28). A plurality of avoidance holes (32) extend through middle circumferential wall with the avoidance hole (32) closest to the second side of the barrier (28) being spaced from the barrier (28) and with the avoidance holes (32) all being out of alignment with the entry hole (20) and all being of smaller diameters than the width of the middle circumferential wall (26). An exit hole (34) is so located in one of the side walls (18) as to intersect the space between the inner and middle circumferential walls.

5 Claims, 5 Drawing Figures

10
16
18
20
22
24
26
28
30
32
34
36
38
2

CYLINDRICAL GAME DEVICE WITH CIRCUMFERENTIAL WALLS

BACKGROUND AND SUMMARY OF THE INVENTION

U.S. Pat. Nos. 876,779, 1,352,517, 3,005,635, and 3,901,510 are illustrative of prior art game devices which are manually manipulable to enable a ball to arrive at a desired destination after avoiding obstacles. This invention is concerned with a game device that enables the ball to arrive at its desired destination in a new and unobvious manner that tests the manipulative skills of the operator.

In its broadest aspect, the game device comprises a cylinder formed of a first outer circumferential wall spanning a pair of side walls. A second circumferential wall spanning the side walls is spaced inwardly of the first circumferential wall. A barrier, spanning the side walls, extends radially between the first and second circumferential walls. An entry passage means provides communication between the space between the first and second circumferential walls adjacent to a first side of the barrier and the exterior of the game device. At least one avoidance hole, and preferably a plurality of avoidance holes, extends through the second circumferential wall. The avoidance hole nearest the second side of the barrier is spaced from the second side of the barrier. An exit passage means provides communication between the avoidance hole or holes and the exterior of the game device.

In the operation of the game, a ball is used that has a smaller diameter than the diameters of the avoidance hole or holes and has a smaller diameter than the entry and exit passage means. The ball is inserted through the entry passage means and falls upon the second circumferential wall. The operator then so manipulates the game device as to try to move the ball past the avoidance hole or holes to the second side of the barrier. If the ball should fall into an avoidance hole before reaching the second side of the barrier, the game is lost. If the ball reaches the second side of the barrier without falling into an avoidance hole, the game is won. If the game is lost, the ball passes through the exit passage means to the exterior of the game device. If the game is won, the operator so manipulates the device as to cause the ball to fall through an avoidance hole and then through the exit passage means to the exterior of the game device.

DESCRIPTION OF THE PREFERRED EMBODIMENT

Figures 1, 2, 3, 4, 5:
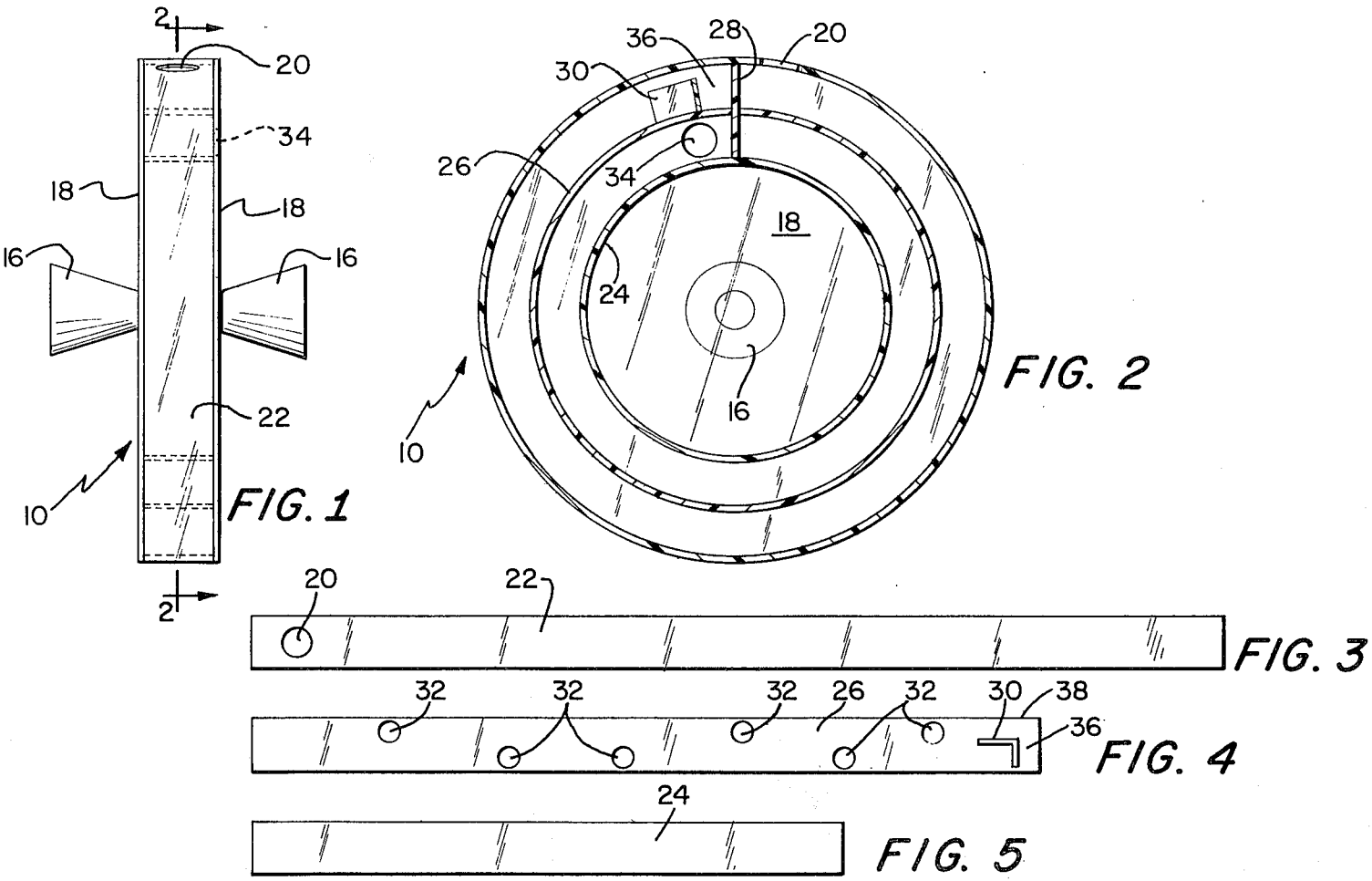
FIG. 1 is an elevation view of the game device.
FIG. 2 is a section taken along the line 2—2 of FIG. 1.
FIG. 3 is a planar developed view of the first circumferential wall.
FIG. 4 is a planar developed view of the second circumferential wall.
FIG. 5 is a planar developed view of the third circumferential wall that forms a part of the passage means.

The game is formed of a hollow cylinder 10. A pair of handles 16 are secured to and extend outwardly from the circular side walls 18 of the cylinder 10 coaxially with the side walls. An entry hole 20 extends through the outer circumferential wall 22 of the cylinder 10.

Located within the cylinder 10 and spaced inwardly of the outer circumferential wall 22 are an inner circumferential wall 24 and a middle circumferential wall 26, the wall 26 being located between the walls 22 and 24. The walls 24 and 26 span and are secured to the side walls 18. A radially extending barrier 28 extends between the circumferential walls 22 and 24 crossing the circumferential wall 26 and also extends between the side walls 18. The entry hole 20 is located clockwise (FIG. 2) of and adjacent to the barrier 28. An L-shaped projection 30 extends outwardly of the wall 26 adjacent to and counterclockwise of the barrier 28. A plurality of avoidance holes 32 of smaller diameters than the width of the wall 26 extends through the wall 26 between the barrier 28 and the projection 30 with all of the holes 32 being out of alignment with the entry hole 20. An exit hole 34 is so located in one of the side walls 18 adjacent to and counterclockwise of the barrier 28 as to intersect the space between the walls 24 and 26.

In the operation of the game, a ball is used that has a smaller diameter than the diameters of the holes 20, 32 and 34. The operator grasps the game by one or both of the handles 16 and drops the ball into the entry hole 20 so that it drops onto the wall 26 clockwise (FIG. 2) of the barrier 28. The operator then manipulates the cylinder 10 by the handles 16 so as to attempt to cause the ball to roll clockwise along the wall 26 past the holes 32 and past the projection 30 into the space 36 between the projection 30 and the barrier 28. Should the ball fall through any of the holes 32 into the space between the walls 24 and 26, the game has been lost and the operator retrieves the ball by so manipulating the cylinder 10 as to cause the ball to pass through the exit hole 34. Should the ball pass by a space 38 between the projection 30 and one of the side walls 18 and arrive at the space 36 without falling through any of the holes 32, the game has been won and the operator retrieves the ball by so manipulating the cylinder 10 as to first cause the ball to pass through one of the holes 32 and then cause the ball to pass through the exit hole 34.

It is preferred that the entire game be made of transparent plastic material. In any event, the wall 22 must be made of transparent material in order to enable the operator to observe the passage of the ball along the wall 26.

There follows a recapituation of those portions of the game device that are germane to this invention.

The game device comprises: the cylinder 10 formed of the pair of side walls 18 and a first outer circumferential wall formed by the wall 22; a second circumferential wall, formed by the wall 26, spanning the side walls 18 and spaced inwardly of the first circumferential wall 22; the barrier 28 extending radially between the first and second circumferential walls 22 and 26 and spanning the side walls 18; an entry passage means, described below, that provides communication between the circumferential walls 22 and 26 and the exterior of the game device; at least one avoidance hole having a diameter smaller than the width of the second circumferential wall 26, formed by one of the holes 32, extending through the second circumferential wall 26 and located spacedly from the second side of the barrier 28; and an exit passage means, described below, providing communication between the avoidance hole 32 and the exterior of the device.

The entry passage means comprises the entry hole 20 extending through the first circumferential wall 22 adjacent to and on said first side of the barrier 28 and out of alignment with the avoidance hole 32.

The said at least one avoidance hole comprises the plurality of avoidance holes 32 randomly located on and extending through the second circumferential wall 26 with the avoidance hole 32 closest to the second side of the barrier 28 being spaced from the second side of the barrier.

The game device further comprises the projection 30 secured to and extending outwardly of the second circumferential wall 26 between the last mentioned avoidance hole 32 and the barrier 28, the projection 30 being spaced from the barrier 28 by the space 36 and being spaced from one of the side walls 18 by the space 38.

The exit passage means comprises: a third inner circumferential wall, formed by the wall 24, spanning the side walls 18 and spaced inwardly of the second circumferential wall 26; and the exit hole 34 located in one of the side walls 18 and intersecting the space between the second circumferential wall 26 and the third circumferential wall 24.

I claim:

1. A game device comprising: a cylinder formed of a pair of side walls and a first outer circumferential wall spanning the side walls; a second circumferential wall spanning the side walls and spaced inwardly of the first circumferential wall; a barrier extending between the first and second circumferential walls and spanning the side walls; an entry passage means providing communication between the space between said circumferential walls adjacent to a first side of the barrier and the exterior of the game device; at least one avoidance hole, having a diameter smaller than the width of the second circumferential wall, extending through the second circumferential wall and located spacedly from the second side of the barrier; and an exit passage means providing communication between the avoidance hole and the exterior of the game device.

2. The device of claim 1 wherein the entry passage means comprises: an entry hole extending through the first circumferential wall adjacent to and on said first side of the barrier and out of alignment with said avoidance hole.

3. The device of claim 1 wherein said at least one avoidance hole comprises a plurality of avoidance holes randomly located on and extending through the second circumferential wall with the avoidance hole closest to the second side of the barrier being spaced from the second side of the barrier.

4. The game device of claim 1 further comprising: a projection secured to an extending outwardly of the second circumferential wall between the avoidance hole closest to the second side of the barrier and the barrier, said projection being spaced from the second side of the barrier and being spaced from at least one of the side walls.

5. The game device of claim 1 wherein said exit passage means comprises: a third inner circumferential wall spanning the side walls and spaced inwardly of the second circumferential wall; and an exit hole located in one of the side walls and intersecting the space between the second and third circumferential walls.

* * * * *